US005417252A

United States Patent [19]

Kurmis

[11] Patent Number: 5,417,252

[45] Date of Patent: May 23, 1995

[54] TOOL FOR BINDING AN OBJECT, BY MEANS OF A STRIP

[75] Inventor: Viktor Kurmis, Pinneberg, Germany

[73] Assignee: Bowthorpe plc, Crawley, England

[21] Appl. No.: 145,963

[22] Filed: Oct. 29, 1993

[30] Foreign Application Priority Data

Nov. 2, 1992 [DE] Germany ..... 9214902 U

[51] Int. Cl.[6] ..... B21F 9/02

[52] U.S. Cl. ..... 140/93.2; 140/93 A

[58] Field of Search ..... 140/93 A, 93.2, 123.5, 140/123.6

[56] References Cited

U.S. PATENT DOCUMENTS

| | | | |
|---|---|---|---|
| 3,946,769 | 3/1976 | Caveney et al. | 140/93.2 |
| 3,976,108 | 8/1976 | Caveney et al. | 140/93 A |
| 4,495,972 | 1/1985 | Walker | 140/93 A |
| 5,042,535 | 8/1991 | Schlottke | 140/93 A |
| 5,050,649 | 9/1991 | Kurmis | 140/93 A |

FOREIGN PATENT DOCUMENTS

| | | |
|---|---|---|
| 0390434A1 | 3/1990 | European Pat. Off. . |
| 0428116A1 | 11/1990 | European Pat. Off. . |

*Primary Examiner*—Lowell A. Larson
*Attorney, Agent, or Firm*—Chilton, Alix & Van Kirk

[57] ABSTRACT

Tool for binding an object (19) by means of a strip which consists of a strip tongue (7) and a lock which is connected to one end of the strip tongue and has a strip opening for retaining the other end of the strip tongue. The tool, which is of elongated construction, has a loop guide (15, 16), which can be opened and closed, on the end of the tool for guiding the strip around the object (19). Provided within the loop guide on the end of the tool is a lock holder (34, 35) from which the loop guide (15, 16) originates and to which it returns. Provided in the tool body is a guide channel (5), which runs approximately parallel to its longitudinal direction, for guiding the strip in its longitudinal direction from an original position into the looping-round and binding position. According to the invention, it is provided that the lock holder (34, 35) is arranged on the end surface of the tool on the circumference of the largest circular cross-section which can be retained by the loop guide (15, 16). The angle between the direction of the end of the strip tongue connected to the lock and the direction of the strip opening on the side facing the loop guide is between 135° and 180 ° . In its end section running to the lock holder, the guide channel (5) contains a guide device for the strip tongue (7), which device is formed by a straight or concavely curved guide surface (3) and a guide element (41) which presses the strip tongue (7) against the guide surface (3).

5 Claims, 3 Drawing Sheets

TOOL FOR BINDING AN OBJECT, BY MEANS OF A STRIP

Figure 1:
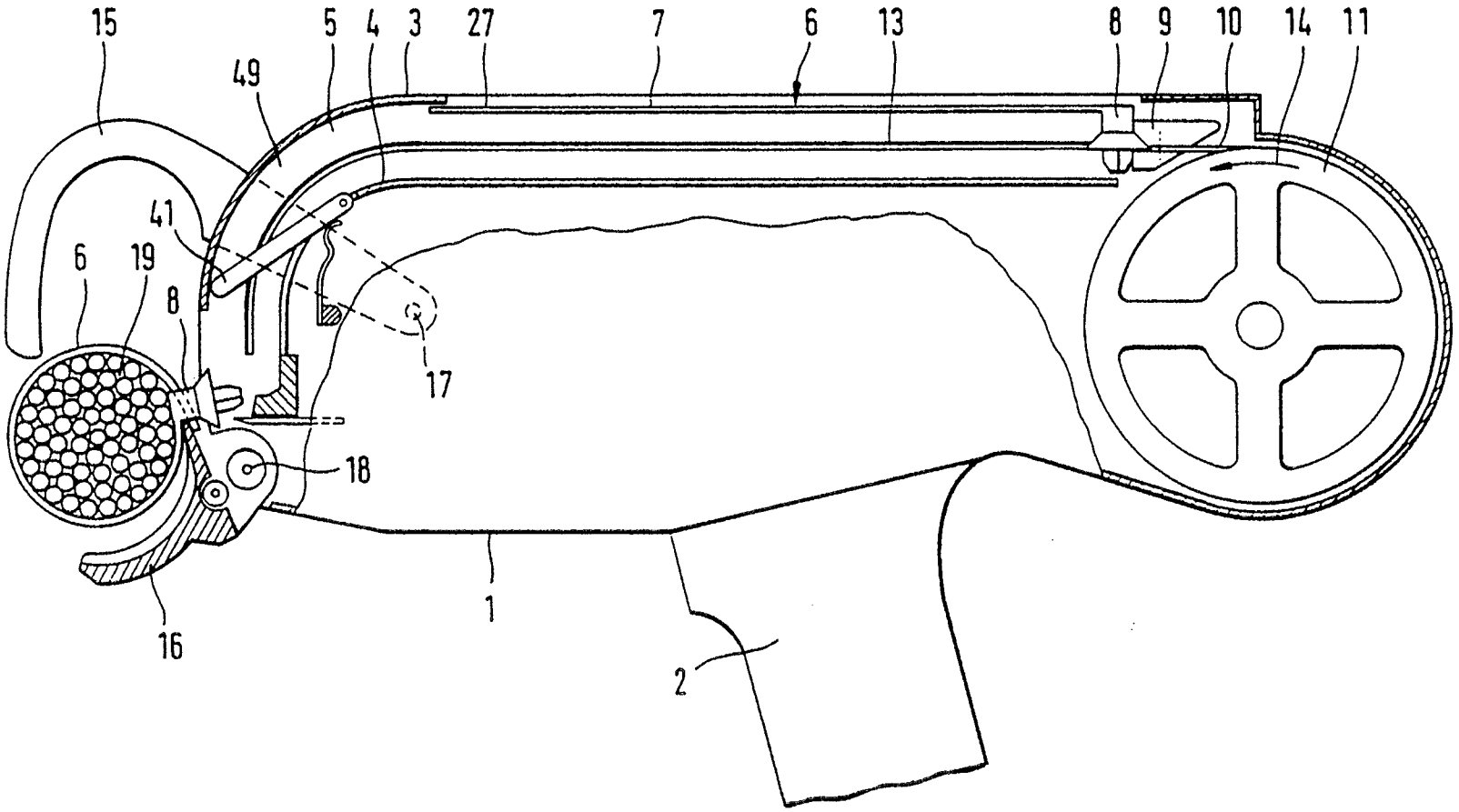

The invention relates to a tool for binding an object by means of a strip which consists of a strip tongue and a lock which is connected to one end of the strip tongue and has a strip opening for receiving the other end of the strip tongue. The tool is elongated. Located on its end is a loop guide which can be opened and closed for guiding the strip around the object, and a lock holder from which the loop guide originates and to which it returns. In its binding position, the strip tongue is located in the loop guide and the lock is located in the lock holder. In order to feed the strip from an original position which can be determined, for example, by a strip magazine, into the binding position, a guide channel is provided which runs approximately parallel to the longitudinal direction of the tool.

In a known tool of this type (U.S. Pat. No. 3,891,012; EP-A 0,264,142) the lock holder is arranged at the tip of an interstice which originates from the cross-section enclosed by the loop guide. Since a bound object (for example a cable harness) has the tendency to deform to the circular cross-section under the tension of the strip, which is not possible within the interstice, either the lock must be displaced from its position at the tip of the filler, during binding, to the circumference of the largest possible circle which can be retained by the loop guide, or the retaining region of the loop guide must be correspondingly expanded, or an inadequate tension of the strip must be accepted. It would be better if it were possible to arrange the lock from the start on the circumference of the largest possible circle which can be retained by the loop guide. However, this runs into difficulties because the guide channel through which the strip passes into the binding position and the end of the loop guide then run onto the lock holder at an acute angle and thus overlap over a relatively large extent. Their mutually overlapping guide surfaces must therefore be cut out to a relatively large distance from the lock holder, although particularly accurate guidance of the forward-running end of the strip tongue is necessary even in the vicinity of the lock holder, in order that this end on the one hand passes correctly into the start of the loop guide and on the other hand finds the strip opening in the lock. It is therefore normal to arrange these guide paths approximately at right angles with respect to one another, because the respective guide devices can then be guided as far as the lock holder. However, this results in the interstice arrangement mentioned above. This also results in a strip form in which the direction of the end of the strip tongue which is connected to the lock and the direction of the strip opening in the lock run approximately at right angles with respect to one another.

By means of the lock holder, the invention seeks to approach closer to the circumference of the maximum possible circular cross-section which can be retained in the loop guide and therefore has to solve the problem of how the forward-running end of the strip tongue can be guided by the lock holder during insertion of the strip into the binding position, from a considerable distance, so accurately that the start of the loop guide is met exactly.

The feature that the angle between the direction of the end of the strip tongue connected to the lock and the direction of the strip opening on the side facing the loop guide is between 135° and 180° corresponds on the tool to the feature that the end of the feed channel and the end of the loop guide are at an acute angle with respect to one another, which has the consequence, mentioned above, of overlapping of the guide path and of the looping-around path on approaching the lock holder. The guide device which provides the strip tongue with the necessary alignment from a relatively large distance from the lock holder consists of a straight or concavely running guide surface which can be formed by the wall of the guide channel, and of a guide element which presses the strip tongue against this guide surface. It must be possible to remove this guide element from that position in which the strip is pressed against the guide surface, in order that the lock of the strip can pass through so far that it corresponds to the dimensions of the lock.

In this way, a high guidance quality is achieved which even allows a bend to be provided in the guide channel in front of its end. This provides the possibility of fitting the lock holder in the end surface of the tool and of feeding the strip parallel to this end surface of the lock holder, although, for space reasons, it is initially located in the section of the guide channel running parallel to the longitudinal direction of the tool.

In the same way as the other parts of the binding mechanism, the guide element can be moved by suitable drive means which, in turn, are controlled so that their timing is matched to the binding process. However, an embodiment is particularly expedient in which the guide element is moved passively by the strip passing through, in that the guide element is formed by a spring-loaded rocker arm which projects into the guide channel at an acute angle with respect to the feed direction of the strip. The strip tongue, which runs at an acute angle between the rocker arm and the wall of the guide channel, presses the rocker arm out of the way and, in consequence, is itself pressed against the wall of the guide channel, as a guide surface. In consequence, it is provided with a defined position and direction.

The strip is pressed by means of a slide through the guide channel, which must thus also pass through between the rocker arm and the guide surface. In order that the guide rocker arm does not block the return movement of the slide, according to the invention, said slide is equipped with a control surface which lifts the guide element off the guide surface.

Seen from the end of the guide channel, a spur can be provided, according to the invention on the other side of the lock holder, which spur separates the start of the loop guide from the region in which the free end of the strip tongue is located after penetrating the strip opening. The strip guide according to the invention must therefore be constructed such that the tip of the strip tongue arrives on that side of the spur which faces the loop guide. The path which the strip end passes through after the object has been bound now lies on the other side of the spur, which strip end is to be engaged and cut off by the clamping device.

Figure 2:
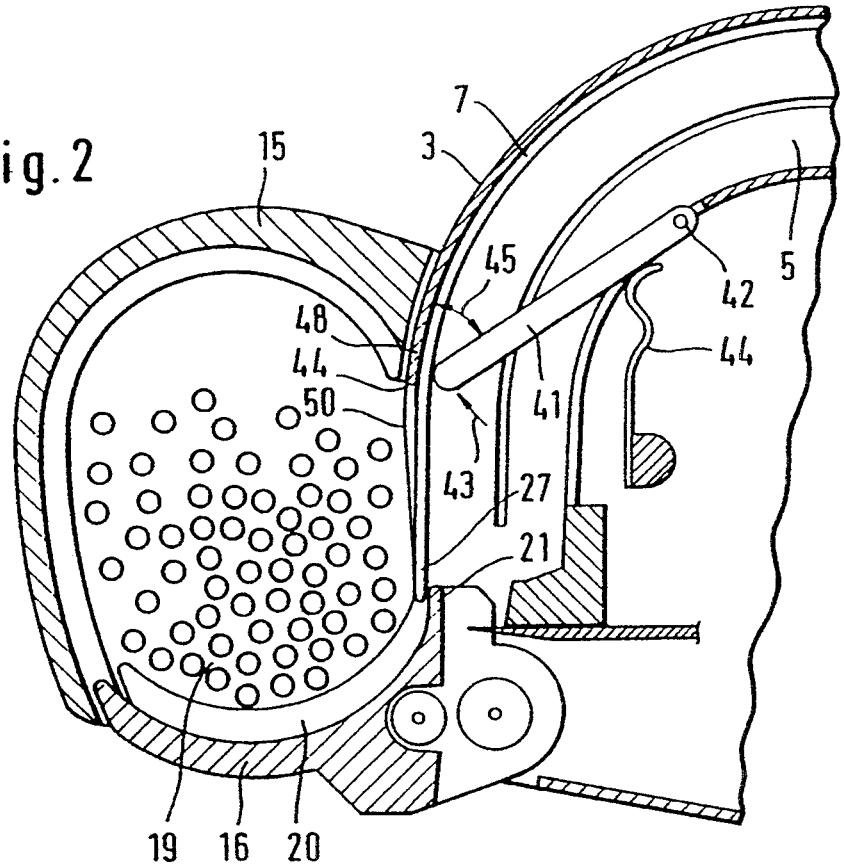
Figure 3:
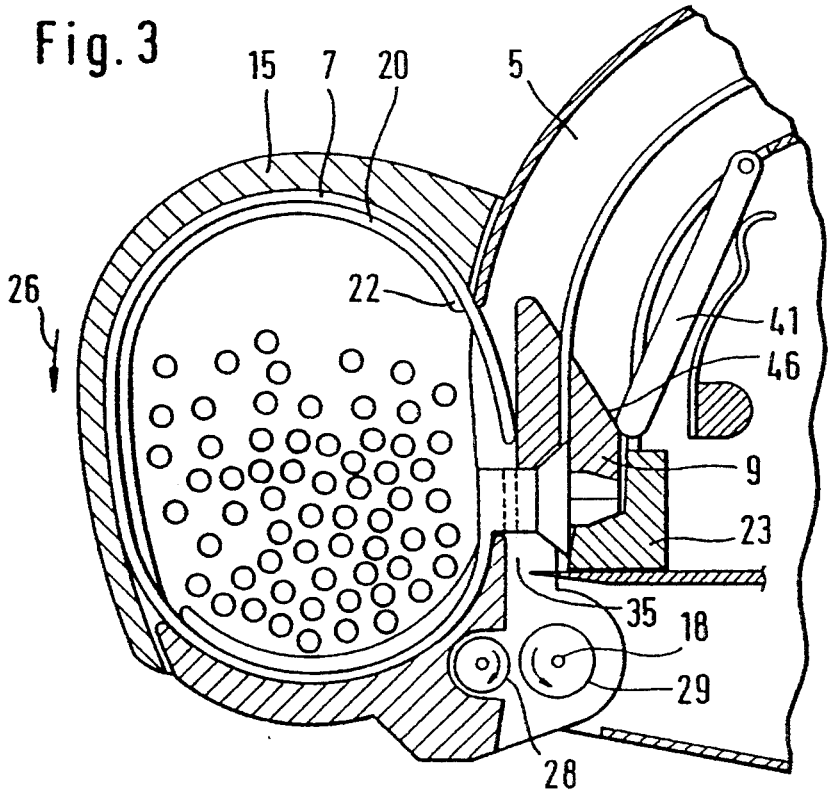
Figure 4:
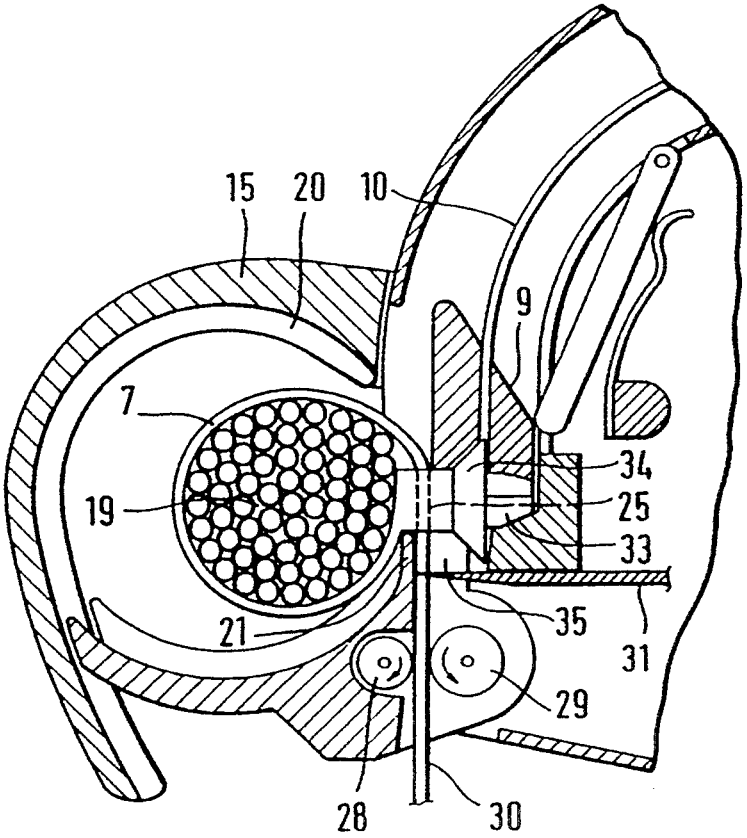
Figure 5:
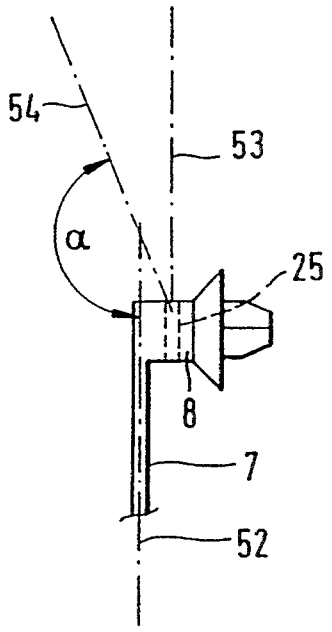

The invention is explained in more detail in the following text, making reference to the drawing which shows an advantageous exemplary embodiment, and in which, FIG. 1 shows a schematic longitudinal section through the tool, FIGS. 2 to 4 show partial sections through the front tool region in different phases of operation, FIG. 5 shows a partial view of the strip with the lock.

According to FIG. 1, the tool has an elongated tool body 1 and a handle 2 by which said tool can be held. A guide channel 5 for a strip 6 consisting of viscoelastic synthetic material, such as polyamide, is located between the walls 3 and 4 of the housing body 1, said guide channel 5 first running in the longitudinal direction of the tool body. Said strip 6 passes in any desired manner into the position inside the section of the channel 5 running in the longitudinal direction of the tool, which is shown in FIG. 1, for example using automatic means, which are not shown, from a strip magazine, or by hand. The strip has a strip tongue 7 and a head 8, the tip 27 of the strip tongue pointing towards the front end of the tool body, which is shown on the left in FIG. 1, while the head 8 is located at the rear. Located behind the lock 8 in the guide channel 5 is a slide head 9 whose end, which interacts with the lock 8, is matched to the shape of the lock 8, and which is attached to the front end of a flexible steel strip 10 which is wound on a roll 11. The head 9 and the steel strip 10 together form a slide for pushing the strip 6 out of the position shown in FIG. 1 into that position (FIG. 3) in which the strip is used for binding an object. When the roll 11 is rotated in the arrow direction 14, the steel strip 10 is pushed forwards with the slide head 9 along the guide channel 5. At the front end of the tool body, the guide channel 5 passes through a bend 49 of approximately 90° in order to end parallel to the end surface of the tool.

At the front end, on its end surface, the tool has pliers which are formed by the parts 15 and 16. Said pliers form a guide for the strip 6 during its movement looping around the object which is to be bound. The part 15 of the pliers can pivot about the axis 17; the part 16 of the pliers can pivot about the axis 18. Drive and control means are provided which ensure that the parts of the pliers can pivot out of the open position shown in FIG. 1 into further functional positions, as is described in more detail below. These drive and control means are of a conventional type and are therefore not shown or explained.

In the opened position (FIG. 1), the pliers receive an object which is to be bound, which may be, for example, a harness of cables 19 (FIG. 2) which is intended to be firmly bound together by means of the strip 6, as is shown in the final phase in FIG. 1. In this phase, the strip tongue 7 surrounds the cable harness 19 under tension. The free end of the strip tongue 7 is guided through the lock 8 and is fixed therein. The projecting end of the strip tongue is cut off.

In order that the strip tongue can be looped around the object 19 which is to be bound, the parts 15 and 16 of the pliers can be moved into a closed looping-round position, according to FIG. 3. They contain a guide groove 20 whose width corresponds approximately to that of the strip tongue 7 and whose depth is considerably greater than the thickness of the strip tongue 7. The guide groove 20 is bounded at its start by a spur 21 which is firmly connected to the part 16 of the pliers. When the tip of the strip tongue 7 is inserted into the start of the guide groove 21, its further movement is determined by this groove around the object 19 which is to be bound and which ends at 22 on the inner end of the part 15 of the pliers.

When this final position is reached, the lock 8 has likewise reached its final position, which is determined by the lock holder. The lock holder and the lock lie, in the end surface of the tool body, on the circumference of the region which, in FIG. 4, is enclosed by the loop guides and defines the circumference of the maximum circular cross-section which can be held in the loop guide. This has the advantage that the object to be bound, for example the cable harness 19, can assume a circular cross-section during binding.

The lock holder comprises a holding part 23 which is fixed to the housing, the already-mentioned spur 21 and region 35 behind the spur 21, which is cut out in the plane of the drawing for the strip to pass through but on the sides thereof (above and below the plane of the drawing) can form stop surfaces for the lock. In the position shown in FIGS. 2 to 4 of the part 16 of the pliers, the spur 21 and the part 35 together with the holding part 23 which is fixed to the housing form a stop which is matched to the shape of the lock 8 such that its position in the holder can be determined unambiguously, provided said lock 8 is pressed against these holding parts. This takes place by means of the slide head 9, which is constructed as a further holding part. As a result of a feed force, which is exerted continuously on the steel strip 10 and can be determined, for example, by means of a sliding clutch or spring in the drive of the roll 11, the slide head 9 presses the lock 8 against the holding parts 21, 23 and in consequence precisely determines the final position of the lock. At the same time, the spur 21 catches between the strip tongue 7, where the latter is integrally connected to the lock 8, and the aperture of the strip opening 25, which is indicated by dashed lines, for receiving the strip tongue in the lock. This means that, during the looping-round movement (FIG. 3), the tip of the strip must pass through on the front side, but behind the spur in the final state. The resting of the spur on the lock body is not absolutely necessary. It is necessary only that all or some of the holding parts 21, 23, 9 interact with the surface of the lock body in such a manner that its position is fixed unambiguously.

The lock is shaped such that the strip takes its origin approximately in the feed direction from the lock and such that the strip opening 25 is approximately parallel to this direction. Precise parallelism is not necessary. The strip opening could rather be rotated, when considering FIG. 3, for example, even a little in the anti-clockwise direction with respect to the direction shown, so that an angle between 180° and 135°, preferably between 180° and 160°, is produced.

These angular relationships are shown more precisely in FIG. 5. In said figure, the strip head 8 can be seen with the strip opening 25 and the end of the strip tongue 7 connected to the lock 8. Its direction 52 at the point where it takes its origin on the lock, and the direction 53 of the strip opening are parallel to one another in the example shown; they thus enclose an angle of 180° with respect to one another. Alternatively, the through-opening and/or the strip origin could be inclined a little to the left in the representation, as is indicated for the strip opening by the direction line 54, which includes an angle $\alpha$ of approximately 160° with the direction 52. Even in the case of a smaller angle down to approximately 135°, the aim can still be achieved of the lock being held in the loop guide or in the tool face and such that it is located virtually on the circumference of the largest possible region which can be enclosed by the loop guide.

When the lock 8 has reached its final position in the lock holder, the free end of the strip tongue is located approximately at the end 22 of the loop guide or between this end and the strip lock 8. The strip tip is preferably close to the lock 8. The strip tip must now be inserted into the strip opening 25 of the lock. This is done (FIG. 3) by the part 15 of the pliers being pivoted further out of the loop position shown in FIG. 3., in the arrow direction 26. In consequence, the extent which is available for retaining the strip tongue 7 is shortened. Since the lock 8 is fixed during this, the strip tip 27 in FIG. 3 must therefore be moved further downwards. When the part 15 of the pliers has reached its final position shown in FIG. 4, the free end of the strip tongue 7 is passed through the strip opening 25, and has reached the gap between two clamping rollers 28, 29, which rotate in the arrow direction during this and grip and clamp the strip end.

According to FIG. 4., the clamping process is continued until the desired tension in the strip tongue 7 is achieved and the object which is to be bound (cable 19) is firmly encircled.

The projecting strip end 30 must now be cut off. Provided for this purpose is a blade 31 which is guided in its longitudinal direction and is connected to conventional drive and control means, which are not shown. In order to make the cut, it is moved to the left in FIG. 4, so that its blade cuts through the strip tongue. At the same time, it uses the spur 21 as an opposing bearing. It may be adequate for this, if the spur forms a smooth bearing surface for the strip in its opposing-bearing region, as shown. However, instead of this, an impression can be provided at this point into the surface of the spur, which depression forms an opposing blade or cutting edge which interacts with the blade.

As can be seen in FIG. 3, the distance between the end 22 of the loop guide and the lock 8 is relatively large. This is a result of the circumstance that the lock holder is arranged directly on the circular circumference of the binding cross-section, which is bounded in FIG. 4 by the inner edges of the parts 15, 16 of the pliers and, in an intermediate region, by the end surface of the housing. In consequence, the feed movement of the strip from the guide channel 5, on the one hand, and the movement of the strip from the loop guide 20, on the other hand, intersect at an acute angle in the distance region between the end 22 of the loop guide and the lock holder. As the complementary angle, this angle corresponds approximately to the angle $\alpha$ between the strip tongue emerging from the lock 8 and the through-opening 25; however, it does not need to be equal to this complementary angle, since the lock, en route from the guide channel 5 to the lock holder, and the strip tongue can make another deflection en route from the end of the loop guide to the lock.

At the start of the loop-around process (FIG. 2), the strip tip which has been pushed forward must pass correctly from the guide channel 5 into the start of the loop guide, which start is formed between the spur 21 and the cables 19 by the beginning of the groove 20. The guide channel 5 is of very broad construction, taking into account the size of the head 8, and can thus not give adequate guidance to the strip tip. The distance between the end 44 of the guide channel and the spur 21 is also very large, which likewise results in guiding uncertainties. Nevertheless, adequate guiding certainty for the strip tip is achieved by means of the invention in the following way.

A rocker arm 41 projects into the guide channel 5, which rocker arm 41 can pivot about the guide axis 42 which is fixed to the housing and runs at right angles to the plane of the drawing. The pivoting axis 42 is arranged such that the rocker arm can be pivoted out entirely from the guide channel 5, against the arrow 43, in order to provide passage for the head 8 of the strip. However, it is acted on by a spring 44 such that it is subject to a restoring force acting in the arrow direction 43. The rocker arm is arranged such that an acute angle 45 is produced between the section 48 of wall 3 of the guide channel 5, with which the rocker arm interacts, and the rocker arm 41, seen from the direction of the strip which is to be pushed forwards. When the strip has been pushed forwards in accordance with FIG. 2, the tip 27 of the strip tongue is thus forced between the wall section 48 of the guide channel and the tip of the rocker arm 41, the strip tongue being pressed against the surface of the wall section 48. It is thus forced precisely in the direction of the wall section 48 in the region in which it is pressed on. This results in a specific direction of the end 27 of the strip tongue emerging beyond the end 44 of the wall 3, which direction is determined in advance such that the tip enters the groove 20 correctly. This direction does not depend on the random position which the strip has previously occupied in the guide channel. The validity of this increases the more the wall 3 is curved in a concave manner in front of, and, possibly, also even in, the wall section 48.

When the head 8 reaches the rocker arm 41, the strip tongue has assumed the position intended for it in the guide groove 20, so that it no longer depends on the guiding tasks of the rocker arm 41. It can therefore be pivoted out further through the head until it has passed through. The final phase is shown in FIG. 3, the rocker arm 41, which is pivoted out from the guide channel 5, resting behind the head 8 on the surface 46 of the slide head 9 provided for this purpose. This surface is constructed such that the slide head 9 can be drawn back without being impeded in this by the rocker arm 41. The latter thereafter returns to its original position, in which it rests on the wall 3.

Once the binding process has been completed in accordance with FIG. 4, the slide 9, 10 can be drawn back into its original position (FIG. 1), and the bound object can be extracted. During the extraction, those parts 21, 23 of the lock holder which are opposite the slide head 9 may be a hindrance if they are firmly arranged and engage in front of any shaped projections of the lock 8. For example, the head 8 which is shown in the drawing has an attachment part 33 which grips a plate 34 which projects on all sides. This plate is located behind the spur 21 and partially behind the holding region 35. However, since these parts 21, 35 are firmly connected to the lower part 16 of the pliers, they are pivoted forwards, and also a little downwards, during the opening movement of the part of the pliers, into the open position shown in FIG. 1. This is achieved by the pivoting point 18 of the part 16 of the pliers being arranged under and behind these parts. These parts therefore move on an arc which is pointed downwards and to the left in the drawing. In consequence, a movement in the extraction direction, like an ejector, acts on the object. The opening also increases in size in consequence, through which the projecting parts of the lock can be extracted, so that the extraction is simplified.

Thereafter, the process can start once again.

I claim:

1. Tool for binding an object by means of a strip (6) which consists of a strip tongue (7) and a lock (8) which is connected to one end of the strip tongue and has a strip opening (25) for retaining the other end of the strip tongue, the tool being elongated and comprising a loop guide (15, 16, 20) movable between open and closed positions, the loop guide being positioned on one end of the elongated tool and having an entrance for receiving the strip tongue, the loop guide being effective for guiding the strip around the object (19), a lock holder (35, 21, 23, 9) positioned at the entrance to the loop guide, and a guide channel (5) extending along the tool from adjacent the lock holder for guiding the strip toward the loop guide for positioning the strip tongue in the loop guide (20) and the lock (8) in the lock holder, characterised in that the lock holder is arranged on the circumference of the largest circular cross-section which can be retained by the loop guide and the angle between the end of the strip tongue connected to the lock and the strip opening is between 135° and 180° on the side of the lock facing the loop guide when the lock is positioned at the entrance of the loop guide, and in that the guide channel is provided with a guide device (3, 41) for the strip tongue (7), which guide device includes a guide surface (3) and a guide element (41) movable toward the guide surface for pressing the strip tongue (7) against the guide surface (3) and movable away from the guide surface (3) by at least the dimension of the lock (8).

2. Tool according to claim 1, characterised in that the guide channel (5) contains a bend (49) between the end of the tool opposite said one end and the lock holder.

3. Tool according to claim 1, characterised in that the guide element is a rocker arm (41) biased toward the guide surface so as to project into the guide channel at an acute angle with respect to the feed direction of the strip.

4. Tool according to claim 3, characterised in that a slide (9, 10) is provided for feeding the strip (6), which slide has a control surface (46) for lifting the guide element (41) off the guide surface (3).

5. Tool according to claim 1, characterised in that a region is provided adjacent the lock holder for receiving said other end of the strip tongue after penetrating the strip opening and the entrance of the loop guide is provided with a spur (21) which separates the loop guide (20) from the region.

* * * * *